US008206084B2

(12) United States Patent
Schmidt et al.

(10) Patent No.: US 8,206,084 B2
(45) Date of Patent: Jun. 26, 2012

(54) BLADE WHEEL

(75) Inventors: Eugen Schmidt, Merbelsrod/Thueringen (DE); Frank Blaurock, Schleusingerneundorf (DE); Juergen Hahn, Guenstedt (DE)

(73) Assignee: Geraete- und Pumpenbau GmbH Dr. Eugen Schmidt, Merbelsrod/Thueringen (DE)

( * ) Notice: Subject to any disclaimer, the term of this patent is extended or adjusted under 35 U.S.C. 154(b) by 746 days.

(21) Appl. No.: 12/308,526

(22) PCT Filed: Jun. 14, 2007

(86) PCT No.: PCT/DE2007/001051

§ 371 (c)(1),
(2), (4) Date: Dec. 17, 2008

(87) PCT Pub. No.: WO2008/000221

PCT Pub. Date: Jan. 3, 2008

(65) Prior Publication Data

US 2009/0226319 A1 Sep. 10, 2009

(30) Foreign Application Priority Data

Jun. 27, 2006 (DE) ..... 10 2006 029 379

(51) Int. Cl.
*F01D 5/14* (2006.01)
*F03D 11/00* (2006.01)
*F04D 29/38* (2006.01)

(52) U.S. Cl. ..... 415/115; 415/116; 416/209; 416/223 R

(58) Field of Classification Search ..... 416/204 R, 416/205, 207, 208, 209, 212 R, 213 R, 213 A, 416/214 R, 223 R; 29/889.2, 889.21; 415/115, 415/116

See application file for complete search history.

(56) References Cited

U.S. PATENT DOCUMENTS

| | | | | |
|---|---|---|---|---|
| 3,298,444 | A | 1/1967 | Haas | |
| 6,033,183 | A | 3/2000 | Genster | |
| 6,506,023 | B1 * | 1/2003 | Chien et al. | 416/186 R |
| 2002/0119049 | A1 | 8/2002 | Chien et al. | |
| 2003/0198555 | A1 | 10/2003 | Tsui | |

FOREIGN PATENT DOCUMENTS

| | | |
|---|---|---|
| DE | 1 628 210 | 2/1971 |
| DE | 26 02 136 | 10/1976 |
| DE | 25 35 196 | 2/1977 |
| DE | 33 43 752 | 6/1985 |
| DE | 200 16 414 | 2/2001 |
| EP | 0 854 294 | 7/1998 |
| GB | 1 523 972 | 9/1978 |
| WO | WO 2005/103499 | 11/2005 |

* cited by examiner

*Primary Examiner* — David Nhu
(74) *Attorney, Agent, or Firm* — Collard & Roe, P.C.

(57) ABSTRACT

A blade wheel consisting of sheet metal for use in motor vehicle refrigerant pumps has blades that are cut out of a disk and pitched and base disk segments that lie adjacent to the blades and remain between the latter. The blade wheel is formed by at least two different blade wheel elements which are provided with cut out, pitched blades, are interconnected in a fixed manner and are arranged so that their respective base disk segments are offset in relation to one another, forming a gap therebetween, the elements thus forming a common bottom disk. A hub sleeve is provided in the center of one of these blade wheel elements (the hub disk), and the center of the other blade wheel element or elements (the bore disk or disks) is provided with a hub sleeve receiving bore, which can be pushed onto the casing of the hub sleeve.

7 Claims, 6 Drawing Sheets

BLADE WHEEL

CROSS REFERENCE TO RELATED APPLICATIONS

Figure 1:
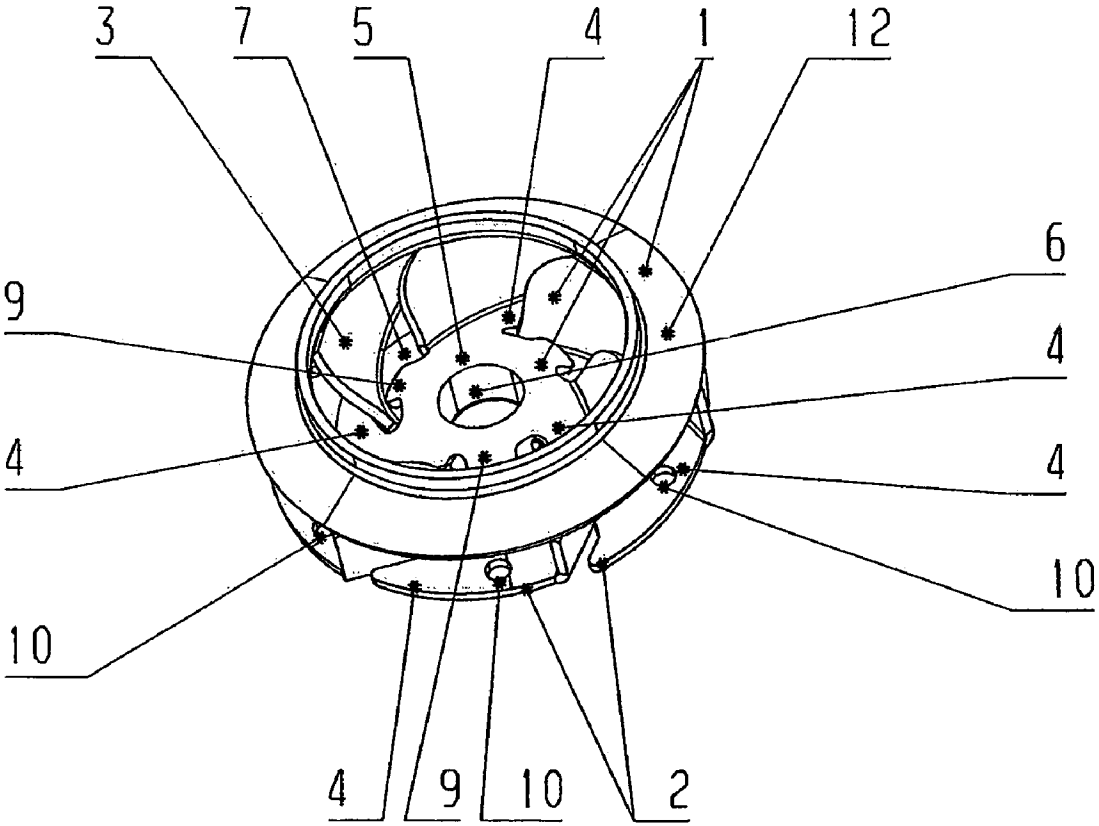

This application is the National Stage of PCT/DE2007/001051 filed on Jun. 14, 2007, which claims priority under 35 U.S.C. §119 of German Application No. 10 2006 029 379.7 filed on Jun. 27, 2006. The international application under PCT article 21(2) was not published in English.

The invention relates to a blade wheel made of sheet metal, for use in motor vehicle coolant pumps.

Small blade wheels made of metal are produced, for example, as precision cast parts, using the lost wax method, or as a sand mold casting.

These construction forms necessarily require high production costs. Also, in the case of the blanks produced as a precision-cast part, the technical possibilities for cleaning and polishing the cast surfaces in the interior of the impeller are greatly restricted, so that in the case of the construction forms produced in this manner, the blade surface quality that can be achieved is necessarily subject to limits.

As the result of a remaining surface roughness, which is dependent on the permissible production costs, in each instance, the degree of conveyance effectiveness that can be achieved is negatively influenced.

For this reason, use of such blade wheels on a large technical scale, for example in coolant pump construction, engine construction and/or automobile construction, is subject to limits (particularly due to the cost-intensive production).

In the state of the art, open blade wheels formed from sheet metal, whose blades are notched out of the bottom disk, are also frequently used.

These construction forms are then also additionally provided with a bottom disk and/or a cover disk, depending on the type of construction.

However, the significant disadvantage of these construction forms consists in the fact that in the case of the blades notched out of the bottom disk, the maximal vane height that is notched out, in each instance, is necessarily dependent on the number of blades of the impeller, and limited by this number.

Since the conveyance amount is dependent on the number of vanes and the vane height, the conveyance amount is necessarily always limited in the case of these construction forms.

For this reason, an attempt was made, by means of the construction form presented in DE 1 628 210 A, for example, to eliminate this aforementioned significant disadvantage of the blade wheels made of sheet metal, having the blades notched out of the bottom disk.

This radial blade wheel made of sheet metal, previously described in DE 1 628 210 A and used as a turbo fan wheel, having a bottom disk and a cover disk and blades disposed between these, distributed uniformly over the circumference, is joined together from U-shaped leaf units of the same type, formed from sheet metal, whereby the individual leaf units consist, in each instance, of a blade with the upper and lower wall segments disposed on it.

Each of these leaf elements overlaps the adjacent leaf element with a part of the upper and the lower wall, and is joined together with the adjacent leaf element in the region of this overlap, by means of connection means.

However, a significant disadvantage of this construction form consists in the fact that this construction form is also very production-intensive, once again.

Furthermore, as the construction form becomes smaller, the power losses increase due to the necessarily required overlaps, and the degree of conveyance effectiveness of the blade wheel constructed as described above clearly decreases.

However, if not only rivet and screw connections are used as connection means, but if, for example, weld connections are also used (for example in the case of small blade wheels), i.e. these very small shaped sheet-metal parts are then welded together with one another to form a blade wheel, the production effort necessarily increases by a multiple, since "warping" necessarily occurs when these individual shaped sheet-metal parts are welded together, which not only has a negative influence on the radial run-out properties and the imbalance behavior, but furthermore also has negative effects in terms of flow technology, and also clearly reduces the degree of conveyance effectiveness, among other things.

Because of the "warping," additional subsequent machining to guarantee the sealing gap relative to the housing furthermore becomes absolutely necessary, so that the production of such small blade wheels is always connected with high costs.

For this reason, such construction forms are by no means used as impellers in motor vehicle coolant pumps.

Since it is also provided, in the case of this aforementioned construction form, that it can be configured with blades, if necessary, curved in the axial direction, their production costs increase (in the case of such special construction forms of blade wheels having three-dimensionally curved blades provided with an upper wall and a lower wall), whereby furthermore, all of the aforementioned disadvantages occur to an even greater degree.

Furthermore, a radial fan wheel composed of wheel segments in the horizontal circular direction, provided with grooves and rails at the join locations, and held together by means of clamps at these join locations, is known from DE 25 35 196 A1.

The significant disadvantage of this construction form consists in the fact that this construction form, too, is very production-intensive, whereby here again, the power losses necessarily increase as the construction form becomes smaller, due to the necessarily required clamps, and thus the degree of effectiveness clearly decreases.

Therefore this construction form, as well, can by no means be used in coolant pumps.

Furthermore, a welded construction made of pre-formed sheet-metal segments, for the production of radial pump wheels, is known from DE 26 02 136 A1.

In this connection, planar sheet-metal formed parts configured approximately in Z shape, in cross-section, are welded onto a hub cut from a pipe, and furthermore connected with one another along their upper and lower edges.

This embodiment, as well, is not suitable for the production of small pump wheels that can be used in coolant pumps, for example, which necessarily must be produced from very small sheet-metal formed parts that are welded to one another, since when these small sheet-metal formed parts are welded (between the blades relative to one another/but also relative to the hub), warping always occurs, which, as was already explained, would have negative effects in terms of flow technology, and necessarily requires subsequent machining to guarantee a degree of effectiveness that is still reasonable.

At the same time, the welding work that is necessary to connect the modules furthermore leads to imbalances on the welded wheel, and requires additional subsequent machining, so that small blade wheels for coolant pumps can be produced, by means of the construction form of a blade wheel made of metal as presented in DE 26 02 136 A1, only with very great production and assembly effort.

Furthermore, an open impeller for flow machines is known from DE 33 43 752 C2, which is also structured as a welded construction and, just like the aforementioned welded construction of a blade wheel, consists of impeller segments.

In the case of this construction form, as well, the impeller segments, which each carry a blade, are welded onto a common hub.

But this construction form is also unsuitable for use as a blade wheel in motor vehicle coolant pumps, since the welding work required to connect the modules (just as in the case of the aforementioned construction form) leads to warping of the blade wheel, on the one hand, and, at the same time, to imbalances on the welded wheel.

As a result of the subsequent machining that again becomes absolutely necessary, the production costs of this construction form are also markedly increased.

The invention is therefore based on the task of developing a blade wheel made of sheet metal, for use in motor vehicle coolant pumps, which does not have the aforementioned disadvantages of the prior art, and in particular, has not only a plurality of blades but also a high blade vane height, and therefore guarantees a great conveyance amount, and at the same time has very good radial run-out properties, without any additional subsequent machining, and furthermore also guarantees an optimal sealing gap relative to the housing, also without additional subsequent machining, while it can be produced in simple and cost-advantageous manner, both in an open construction form (without a cover disk) and in a closed construction form (with a cover disk), and, at the same time, is also characterized by a high degree of conveyance effectiveness.

This task is accomplished, according to the invention, by means of a blade wheel made of sheet metal, for use in motor vehicle coolant pumps, in accordance with the characteristics of the main claim of the invention.

Advantageous embodiments and details of the invention are evident from the dependent claims, and from the following description of the exemplary embodiment according to the invention, in connection with the drawings relating to the solution according to the invention.

In the following, the invention will now be explained in greater detail using an exemplary embodiment, in connection with ten figures.

Figure 3:
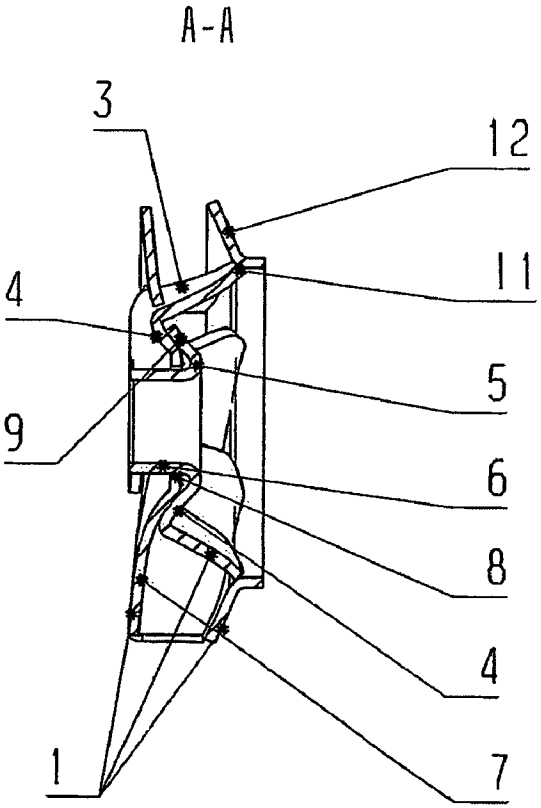
Figure 2:
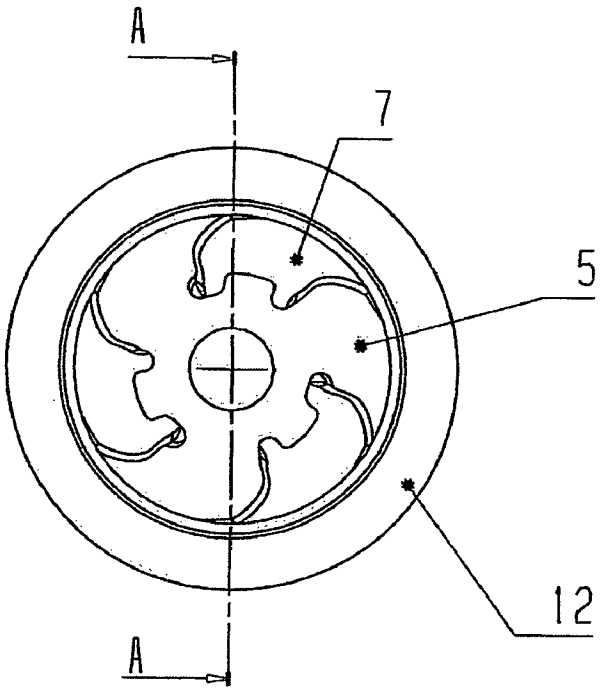
Figure 4:
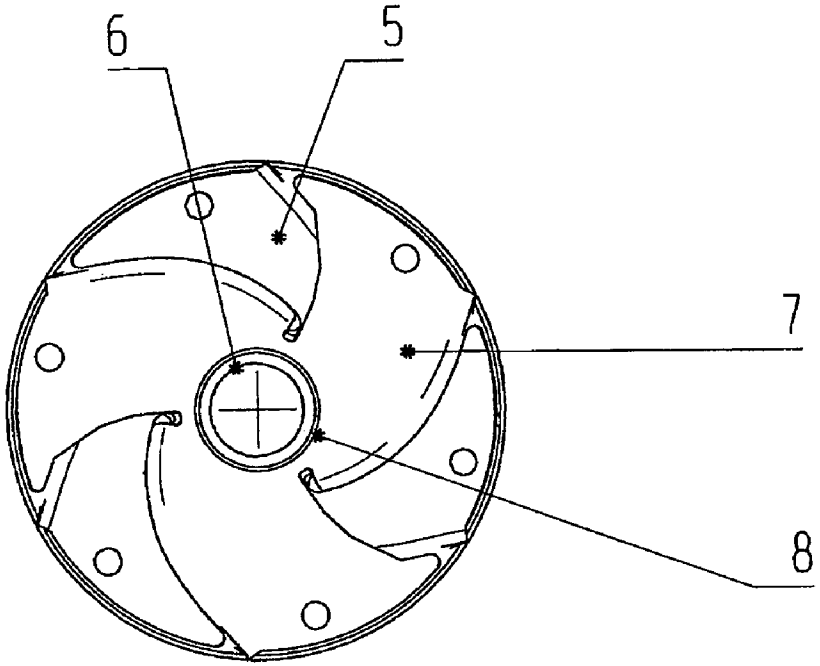
Figure 6:
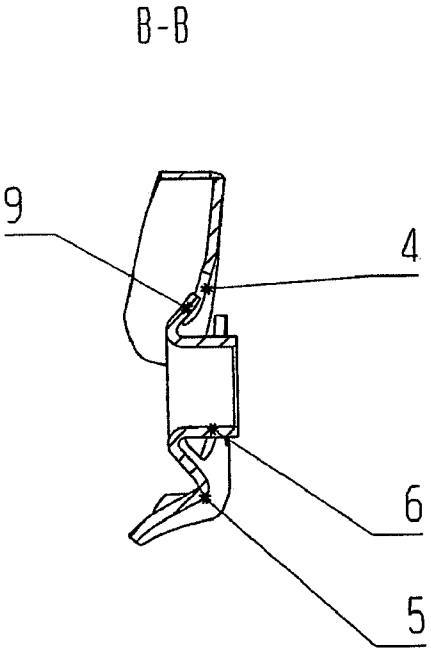
Figure 5:
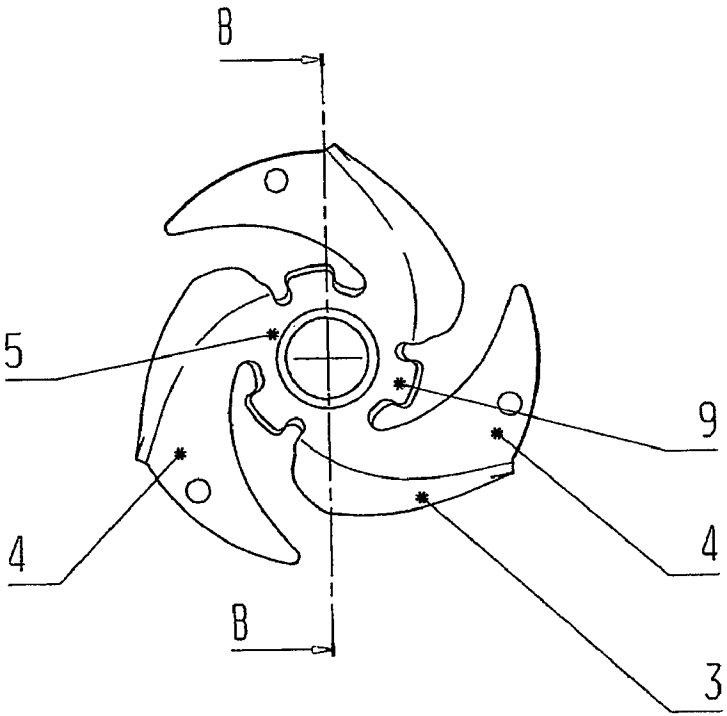
Figure 8:
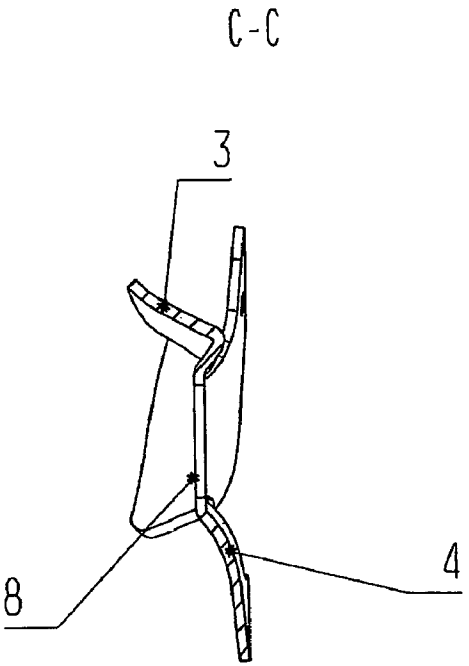
Figure 7:
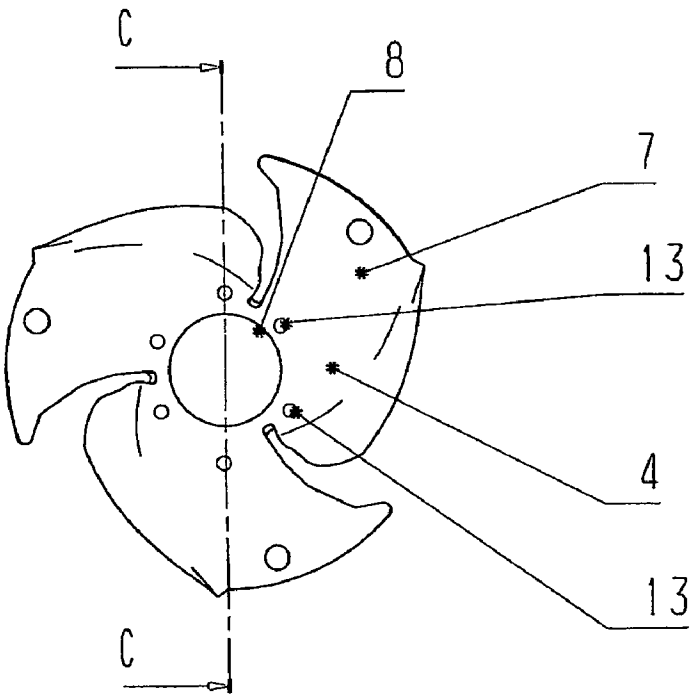
Figure 10:
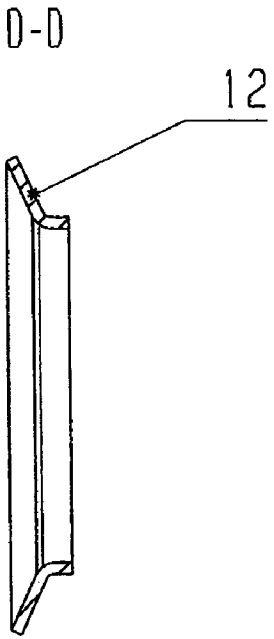
Figure 9:
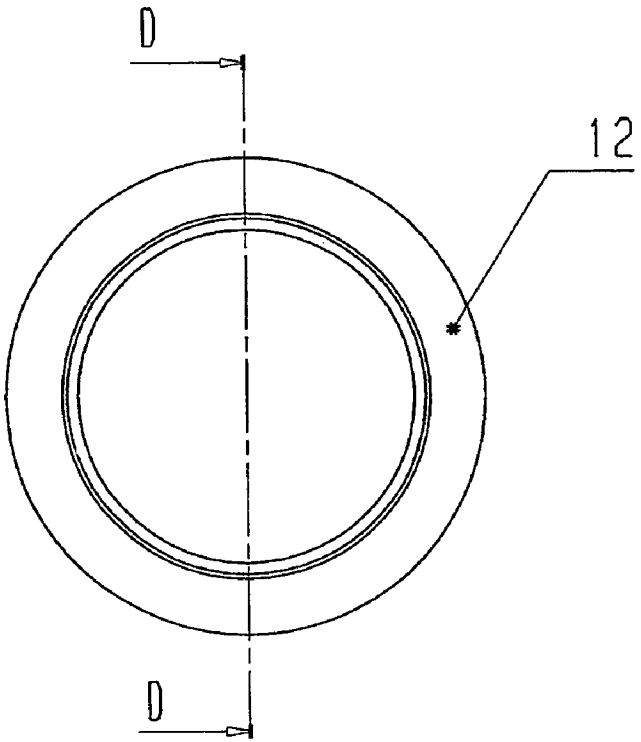

These figures show:

FIG. 1: a spatial representation of the blade wheel 1 according to the invention, in the construction form having a cover disk 12, a domed bottom disk 2, and three-dimensionally curved blades 3, in the completely assembled state;

FIG. 2: the top view of the construction form of the blade wheel 1 according to the invention shown in FIG. 1;

FIG. 3: the blade wheel according to the invention in section, at A-A according to FIG. 2;

FIG. 4: the blade wheel 1 according to FIG. 1, in a view from the bottom;

FIG. 5: the hub disk 5 according to the invention, according to the representation in FIG. 1, in a top view;

FIG. 6: the hub disk 5 according to the invention, in section, at B-B, according to FIG. 5;

FIG. 7: the bore disk 7 according to the invention, according to the representation in FIG. 1, in a top view;

FIG. 8: the bore disk 7 according to the invention, in section at C-C, according to FIG. 7;

FIG. 9: the cover disk 12 according to the invention, according to the representation according to FIG. 1, in a top view;

FIG. 10: the cover disk 12 according to the invention, in section at D-D, according to FIG. 9.

FIG. 1 shows a spatial representation of the blade wheel 1 according to the invention, in the construction form having a cover disk 12, a domed bottom disk 2, and three-dimensionally curved blades 3, in the completely assembled state.

This blade wheel 1, which is produced from sheet metal, is intended for use in motor vehicle coolant pumps, and consists, in the construction form being presented here, of two blade wheel elements having blades 3 that are notched out and positioned, which elements are firmly connected with one another, and disposed offset at a "gap" with their bottom disk segments 4, in each instance, so that the two blade wheel elements together form a bottom disk 2.

In one of the blade wheel elements, the hub disk 5, a hub sleeve 6 is disposed centrally, and in the other of the two blade wheel elements, the bore disk 7, a hub sleeve accommodation bore 8, which can be set onto the outer mantle of the hub sleeve 6, is also disposed centrally.

The construction form according to the invention thus makes it possible that in addition to many blades on the blade wheel 1, at the same time, a great blade vane height can be implemented, so that a great conveyance amount can be guaranteed by means of the solution according to the invention.

Because of the arrangement, according to the invention, of two blade wheel elements, centered within one another, which in themselves already demonstrate radial run-out properties, optimal radial run-out properties are guaranteed without any subsequent machining.

At the same time, an optimal sealing gap relative to the housing is guaranteed by the aforementioned arrangement according to the invention, without subsequent machining.

The blade wheel according to the invention, formed from the blade wheel elements, the hub disk 5, and the bore disk 7, can furthermore always be produced in simple and cost-advantageous manner.

In connection with the use of deep-drawn steel sheet metal, a high level of blade surface quality is furthermore guaranteed, so that the blade wheel 1 having the structure according to the invention (provided with many, high blades, which does not tend to warp when its elements are connected) is characterized by a high degree of conveyance effectiveness.

It is also essential that connection tabs 9 are disposed at the hub edge of the hub disk 5, between the bottom disk segments 4, in each instance.

To simplify production, positioning elements 10, here in the form of bores, are disposed on the bottom disk segments 4 of the hub disk 5, and on the bottom disk segments 4 of the bore disk 7.

These serve for precise positioning of the two modules in a spot-welding device, for example.

By means of this device, for example, the two blade wheel elements according to the invention can be welded together with one another in the region of the bottom disk segments 4 that overlap one another, and in the region of the overlaps of the bottom disk segments 4 with the connection tabs 9.

As a result of the disk-shaped construction form according to the invention, of the two blade wheel elements spot-welded to one another in the interior region, warping of the blade wheel 1 formed in this manner is furthermore avoided, at the same time.

In FIG. 2, the top view of the construction form of the blade wheel according to the invention presented in FIG. 1, consisting of a hub disk 5 and a bore disk 7, with a cover disk 12, is shown.

FIG. 3 shows the blade wheel according to the invention in section, at A-A according to FIG. 2, with the cover disk 12 spot-welded on at the upper edges 11 of the blades 3 of the blade wheel 1.

FIG. 3 shows that the connection tabs 9 lie approximately in the plane of the bottom disk segments 4 disposed on the hub disk 5, and thereby form not only a flow-advantageous transition, but, at the same time, an optimal contact for the bottom disk segments 4 of the bore disk 7, and, at the same time, allow an optimal spot-welding connection of the two blade wheel elements.

Likewise, this FIG. 3 shows that the common bottom disk formed by the blade wheel elements is domed, and the blades 3 are configured to be three-dimensionally curved, in each instance.

In FIG. 4, the blade wheel according to the invention, according to FIG. 1, is shown in a view from below, with the hub sleeve 6 disposed on the hub disk 5, and the hub accommodation bore 8 disposed in the bore disk 7.

FIG. 5 shows the hub disk 5 according to the invention, according to the representation according to FIG. 1 in a top view, as an individual part, together with the bottom disk segments 4 disposed on it, the blades 3 notched out of the bottom disk, and the connection tabs 9 disposed between the bottom disk segments 4 (i.e. each bottom disk segment 4 and the blade 3 of the adjacent bottom disk segment, in each instance).

In FIG. 6, this hub disk 5 according to the invention is now shown in section, at B-B according to FIG. 5, with the hub sleeve 6 disposed on the hub disk 5.

This representation also shows that the connection tabs 9 lie approximately in the plane of the bottom disk segments 4 disposed on the hub disk 5.

FIG. 7 now shows the related second blade wheel element, the bore disk 7 according to the invention, in a top view, with the weld bosses 13 disposed on the bottom disk segments 4, close to the hub sleeve accommodation bore 8 (for spot-welding to the hub disk).

In FIG. 8, the bore disk according to the invention is shown in section, at C-C according to FIG. 7, with the domed bottom disk segment 4 and the three-dimensionally curved blade 3.

FIG. 9 shows the cover disk 12 according to the invention, in a top view.

In FIG. 10, the cover disk 12 according to the invention is shown in section, at D-D according to FIG. 9.

By means of the solution according to the invention, it has been possible to develop a blade wheel made of sheet metal, for use in motor vehicle coolant pumps, which has not only many blades but, at the same time, a high blade vane height, thereby guarantees a desired great conveyance amount, furthermore, as a result of the configuration according to the invention, also has very good radial run-out properties, without any subsequent machining, and furthermore also guarantees an optimal sealing gap relative to the housing, also without any subsequent machining.

At the same time, the blade wheel according to the invention can also be produced in simple and cost-advantageous manner, both in an open construction form (without cover disk) and in a closed construction form (with cover disk), in large series production.

Since the blade wheel according to the invention furthermore has a high level of blade surface quality, because of the material used, a high degree of conveyance effectiveness is always guaranteed, at the same time, in connection with the construction form of the blade wheel according to the invention.

REFERENCE SYMBOL LIST

1 blade wheel
2 bottom disk
3 blade
4 bottom disk segment
5 hub disk
6 hub sleeve
7 bore disk
8 hub sleeve accommodation bore
9 connection tab
10 positioning element
11 upper edge
12 cover disk
13 weld boss

The invention claimed is:

1. A blade wheel made of sheet metal, for use in motor vehicle coolant pumps, having blades that are notched out of a disk and positioned, and bottom disk segments disposed adjacent to them, remaining between the notched-out blades, wherein the blade wheel is formed by at least two blade wheel elements provided with notched-out and positioned blades formed in one piece, thereby provided with complete blades, in each instance, firmly connected with one another, which are disposed offset at a "gap" with their bottom disk segments, in each instance, and thereby together form a bottom disk, whereby in one of the at least two blade wheel elements, the hub disk, a hub sleeve is disposed centrally, and in the other(s) of these blade wheel elements, the bore disk(s), a hub sleeve accommodation bore, set onto the outer mantle of the hub sleeve, is also disposed centrally.

2. The blade wheel according to claim 1, wherein a/multiple connection tab(s) are disposed on the hub edge of the hub disk, between the bottom disk segments, in each instance.

3. The blade wheel according to claim 1, wherein connection and/or positioning elements are disposed on the hub disk and on the bore disk(s).

4. The blade wheel according to claim 2, wherein the connection tabs lie approximately in the plane of the bottom disk segments disposed on the hub disk.

5. The blade wheel according to claim 1, wherein a cover disk is disposed on the upper edges of the blades of the blade wheel.

6. The blade wheel according to claim 1, wherein the common bottom disk formed by the blade wheel elements is configured to be domed.

7. The blade wheel according to claim 1, wherein the blades are configured to be three-dimensionally curved.

* * * * *